US005350082A

United States Patent [19]

Kiriakides, Jr. et al.

[11] Patent Number: 5,350,082

[45] Date of Patent: Sep. 27, 1994

[54] AUTOMATIC SODA FOUNTAIN AND METHOD

[75] Inventors: Alex Kiriakides, Jr., 205 Sweetbrier Rd., Greenville, S.C. 29606; Thomas L. Cox, Greenville, S.C.

[73] Assignee: Alex Kiriakides, Jr., Greenville, S.C.

[21] Appl. No.: 973,428

[22] Filed: Nov. 9, 1992

[51] Int. Cl.[5] ..... G07F 13/10

[52] U.S. Cl. ..... 221/1; 221/96; 222/148; 222/641

[58] Field of Search ..... 221/96, 125; 222/641, 222/129.4, 148

[56] References Cited

U.S. PATENT DOCUMENTS

| | | | |
|---|---|---|---|
| 2,834,190 | 5/1958 | Andrews et al. . | |
| 2,994,421 | 8/1961 | Yingst et al. . | |
| 3,169,669 | 2/1965 | Maxwell . | |
| 4,517,651 | 5/1985 | Kawasaki et al. | 364/479 |
| 4,537,336 | 8/1985 | Verduin et al. | 222/641 |
| 4,628,974 | 12/1986 | Meyer | 141/129 |
| 4,765,513 | 8/1988 | McMillin et al. | 222/148 X |
| 4,944,337 | 7/1990 | Credle et al. | 221/96 X |
| 4,962,866 | 10/1990 | Phillips | 221/96 X |
| 4,967,932 | 11/1990 | Wiley et al. | 221/1 |
| 5,188,255 | 2/1993 | Du | 222/148 X |

FOREIGN PATENT DOCUMENTS 2146621A 4/1985 United Kingdom .

*Primary Examiner*—F. J. Bartuska
*Attorney, Agent, or Firm*—Cort Flint

[57] ABSTRACT

A money activated beverage dispensing line is disclosed of the soda fountain type in which the dispensing of a beverage from a series of dispensing stations is automatically controlled with consumer interaction. The dispensing line includes a money validator which generates a start signal in response to a correct amount of money being detected as deposited by the consumer. In response to the start signal, a cup dispenser dispenses a cup. An ice dispenser subsequently dispenses ice into the cup. A beverage dispenser at a remote station includes a plurality of beverage dispensing nozzles having dispensing switches which must be manually activated by the consumer to dispense a selected beverage. An interlock control responsive to actuation of a beverage dispensing switch associated with a selected beverage dispensing nozzle disenables a remainder of the dispensing nozzles so that dispensing of beverage from the remainder of dispensing nozzles is prevented during a beverage dispensing cycle. A remote supply cabinet is utilized to supply concentrated syrup to the beverage dispenser. Advantageously, the supply cabinet may be disposed in another room, or up to 200 feet away, so that it does not take up space along with the automated dispensing line, and so it can be serviced out of sight from the dispensing line. Hot water rinsing nozzles are provided at the supply cabinet and at the dispensing nozzles, along with drains, so that the syrup packages and nozzles can be rinsed and maintained in a hygienic condition.

35 Claims, 5 Drawing Sheets

AUTOMATIC SODA FOUNTAIN AND METHOD

BACKGROUND OF THE INVENTION

The invention relates to the dispensing of beverages from a money operated dispensing line in the form of a soda fountain in an automatic manner, and method.

Soda fountain type dispensing lines operated manually by the consumer have become increasingly popular in convenience stores, fast-food restaurants and the like. However, the problem occurs that the use and operation of the beverage dispensing line cannot always be effectively monitored. The consumer operated beverage dispensing line in such facilities is often abused. This results in loss of revenues and waste. It is also difficult to achieve a consistent quality of dispensed beverage. The consumer operated beverage dispensing line typically includes a cup rack from which is a cup is manually dispensed by the consumer. Next, there is an ice dispenser typically actuated by a lever pressed against by the cup as held by the purchaser. Next, there is a beverage syrup dispenser also typically actuated by engagement with the cup held by the purchaser. The number of cups, amount of ice, and amount of beverage syrup dispensed is wholly at the control of the consumer. The waste of cups, ice, and syrup and dispensing of a consistent and quality drink are problems to which considerable attention need be given.

Automatic, coin-operated vending machines are known which dispense a cup, ice, and beverage in a single automated cabinet. For example, see U.S. Pat. Nos. 3,169,669; 2,994,421; 2,834,190; and published UK Patent Application no. 2,146,621. The prior vending machines are commonly referred to as "cold drink cup machines". The typical cold drink cup machine includes a single cabinet containing a cup dispenser, and an ice maker which makes ice for dispensing into the cup. The cabinet also contains a number of syrup containers having removable lids so that the syrup can be replenished. The syrup is dispensed along with carbonated water, also supplied from the cabinet, into the cup. A money validator senses the correct amount of money. A cold water bath in the cabinet is maintained at a cold temperature. The carbonated water is produced by a carbonator which carbonates water and has a coil disposed in the cold bath. In addition, there are syrup lines also immersed in cold bath to cool the syrup. However there is always a certain distance of tubing which contains syrup and carbonated water between the water bath and dispensing nozzle that is not cooled. Accordingly, there is a always a certain amount of warm syrup dispensed into the drink. The dispensing head typically includes a dispensing opening for the water and a plurality of the dispensing openings for the syrup so that they are not actually mixed, but are dispensed individually into the cup and mixed in the cup. The syrup containers normally have loose lids. When the syrup is replaced, new syrup is poured on top of the old syrup which often results in a syrup which is not totally fresh. Also, the syrups in the different container can be accidentally mixed.

In addition, while a program for maintaining the cold drink cup machine is often in place, the maintenance is often not carried out because the machine is locked and requires a trained technician to clean properly. There are many lines in the machine in which water and other fluids remain in continuously. These lines becomes contaminated or dirty due to the standing liquid in the lines.

The pumps that pump the syrup are diaphragm type pumps which become uncalibrated through continuous use due to the stretching of the diaphragm and other things. In sum, the machine includes many features that are complicated and require adjustment and it is difficult to keep such machines well adjusted and clean so that a consistent quality beverage is dispensed.

The above shortcomings account for some of the unpopularity of beverages dispensed from cold drink cup machines, and the increasing popularity of beverages dispensed from soda fountain type dispensing lines.

Various automatic controls have been employed in beverage dispensing systems. For example, U.S. Pat. No. 4,517,651 discloses an automatic control system for a cup vending machine which makes use of a microcomputer to compute the time duration for supply of component materials in accordance with stored data and supplied input data. U.S. Pat. No. 4,967,932 discloses a system which has an automatic dispenser unit having a cup conveyor. A cup is automatically dropped and filled with ice at a cup drop position. The cup is then moved by the conveyor to a beverage dispenser. The system employs mechanical arms to move the cups and sensors to detect the position of the cups whereby beverages may be automatically dispensed, particularly, in an assembly line fashion. U.S. Pat. No. 4,628,974 discloses an automated assembly for flowable material having a robot arm which grasps a glass and moves the glass to an ice dispenser and liquor dispenser. The drink is then delivered to the consumer. The cold drink cup machines typically use a timing motor and rotating cam plate arrangement to control the various dispensing times. However, none of the previous automatic systems are suitable for dispensing beverages from a soda fountain dispensing line with remote dispensing stations wherein the consumer handles the cup and interacts with the system at different stations.

Accordingly, an object of the present invention is to provide a money activated, beverage dispensing line having a series of remote stations operated by a consumer in an automated manner to provide a quality drink with reduced waste.

Another object of the present invention is to provide a money activated beverage dispensing line of the soda fountain type which is automatic but allows the consumer to have some interaction so that consumers feel they have some control over the dispensing of the beverage and that the beverage is self-made.

Another object of the invention is to provide an automated Beverage dispensing line of the soda fountain type which can be operated by a consumer whom interacts with the system to control the dispensing of a cup, ice, and beverage syrup in a manner that controls waste and quality.

SUMMARY OF THE INVENTION

In accordance with the present invention, the above objectives are accomplished according to the present invention by providing a money operated beverage dispensing system for dispensing a beverage to a consumer in an automated and interactive manner comprising a beverage dispensing line having a series of remote dispensing stations controlled automatically and operated with consumer interaction. The beverage line includes a money validator for receiving money from a consumer. The money validator generates a start signal representing a start of a beverage dispensing cycle in response to detecting a prescribed amount of money. A cup dispensing station has a cup dispenser for dispensing a cup which is manually received and transported to subsequent stations by the consumer. A remote ice dispensing station is spaced a distance from the cup dispensing station to which the cup is transported by the consumer. The ice dispensing station has having an ice dispenser for dispensing ice into the cup manually positioned by the consumer at the ice dispenser. A first switch is associated with the ice dispenser and is actuated by the consumer for dispensing the ice into the cup upon actuation. A remote beverage dispensing station is spaced a distance from the ice dispensing station to which the cup is transported by the consumer. The beverage dispensing station includes a beverage dispenser having a plurality of dispensing nozzles for dispensing a beverage manually positioned by the consumer. A plurality of second, nozzle switches are associated with the beverage dispenser nozzles and are manually actuated by the consumer for dispensing the beverage into the cup upon actuation.

An automatic controller is provided for controlling the cup dispenser, the ice dispenser, and the beverage dispenser. The controller activates the cup dispenser to dispense the cup in response to the start signal. The controller activates the ice dispenser after dispensing of the cup to dispense an amount of ice into the manually positioned cup upon actuation of the first switch by the consumer. The controller activates the beverage dispenser after dispensing of the ice for dispensing a prescribed amount of beverage into the manually positioned cup upon actuation of the second switch by the consumer. The automatic controller includes a first timer for generating a first signal to activate the cup dispenser. A second timer generates a second signal and activates the ice dispenser for a first prescribed time period. During that time, the consumer actuates the first switch at the ice dispenser. A third timer generates a third signal and activates the beverage dispenser for a second prescribed time period. During that time, the consumer actuates the second, nozzle switch at the beverage dispenser. An interlock control responsive to actuation of a selected nozzle switch associated with a selected beverage dispensing nozzle disenables a remainder of the dispensing nozzles so that dispensing of beverage from the remainder of dispensing nozzles is prevented during the beverage dispensing cycle. The controller generates a reset signal for resetting the beverage dispensing cycle after the second prescribed time period.

The system includes a supply cabinet remote from the dispensing line enclosing a plurality of beverage syrup sources and beverage pumps for transferring syrup to the beverage dispenser. A carbonator supplies carbonated water to the beverage dispenser. A spill tray is carried underneath the beverage sources having a drain, and means for rinsing the spill tray to clean the tray from spills of the syrup. The beverage dispenser comprises a plurality of mixing and dispensing nozzles which mix carbonated water with a syrup from the beverage source for dispensing the beverage. The beverage dispensing station also includes rinsing means for rinsing the mixing and dispensing nozzles to maintain the nozzles in a hygienic condition. The beverage dispensing station includes a collection tray for collecting and draining the rinsing fluid.

The invention includes a method for automatically controlling a beverage dispensing line of the type described above having a series of remote dispensing stations including a cup dispensing station, a remote ice dispensing station and an associated first manual switch, and a remote beverage dispensing station and an associated second manual switch. The method comprises providing a money validator which receives money, and generating a cycle start signal in response to the money validator detecting a prescribed amount of money. The method includes automatically controlling the cup dispenser to dispense a cup in response to a first signal generated in response to the start signal, and afterwards generating a second signal. Next, the ice dispenser is activated in response to the second signal, and ice is automatically dispensed from the activated ice dispenser into the cup upon manual actuation of the first switch by the consumer. A third signal is generated by the controller after dispensing of the ice. The beverage dispenser is activated in response to the third signal, and a prescribed amount of beverage is dispensed into the manually positioned cup upon actuation of the second switch by the consumer. Power to the remaining dispensing nozzles is automatically interrupted upon actuation of a desired nozzle switch during said beverage dispensing cycle to prevent dispensing from one of the remaining, non-selected nozzles. Further, the method includes activating visual indicators associated at least with the ice dispenser and the beverage dispenser indicating that the ice dispenser and the beverage dispenser are activated in response to the first and second signals, respectively. In accordance with the method, the beverage dispensing line is reset after the beverage is dispensed.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
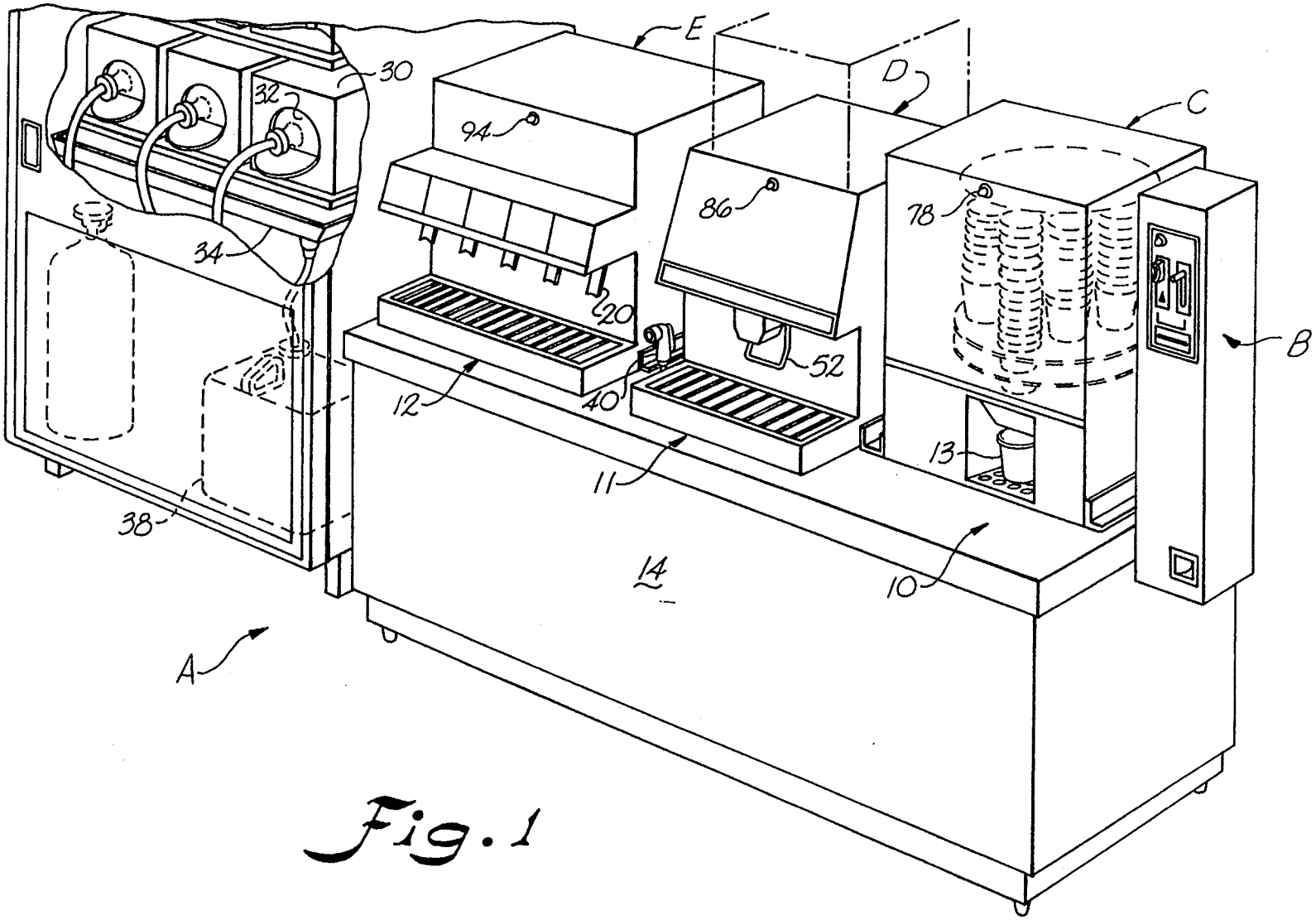
FIG. 1 is a perspective view illustrating an automated beverage dispensing line having remote stations in accordance with the present invention.
Figure 2:
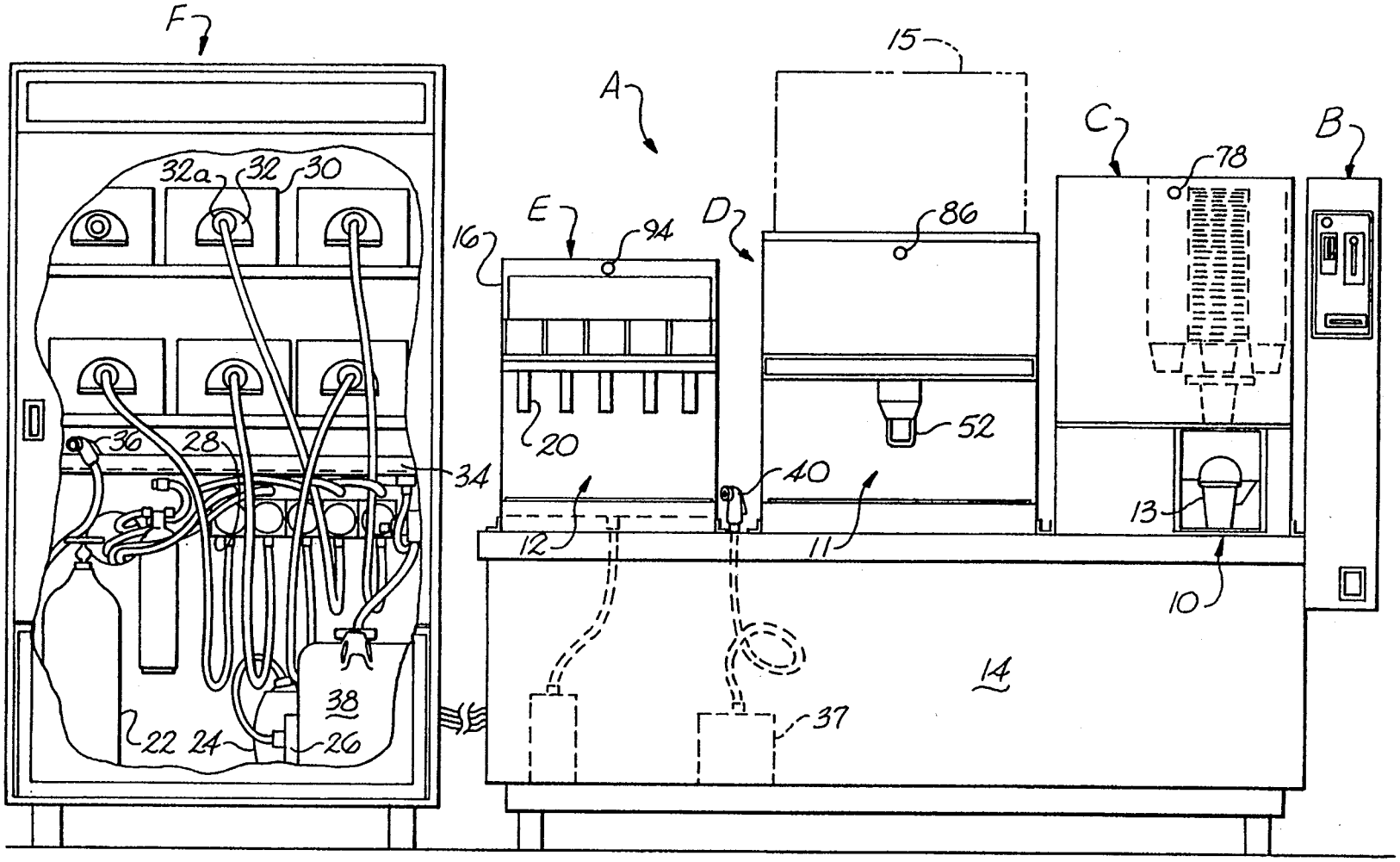
FIG. 2 is a front elevation of an automated beverage dispensing line of the soda fountain type activated by money and controlled in an automated and interactive manner with the consumer.

Referring now in more detail to the drawings, an automated beverage dispensing line will be described in the preferred form of a soda fountain which is money activated and consumer interactive. As can best be seen in FIGS. 1 and 2, the automated beverage dispensing line, designated generally as A, includes a money validator unit B, a cup dispensing station 10 having a cup dispenser C, an ice dispensing station 11, having an ice dispenser D, and a beverage dispensing station 12, having a beverage dispenser E. In addition, there is a supply cabinet F which is preferably disposed at a remote location. The various stations and dispensers comprising the automated dispensing line are remote from each other and are operated in a consumer interactive manner. For example, money is deposited in money validator unit B which activates cup dispenser 10. A cup 13 is received and grasped by the consumer. The consumer takes cup 13 to the ice dispensing station D and beverage dispensing station E. The different stations and dispensers are tied together by the money activated and consumer interactive control system in an automated manner. Supply cabinet F may be disposed at a remote location up to 200 feet away from the automatic dispensing line so that the supplies can be serviced out of sight from the dispensing line. While the different dispenser units and stations are illustrated as individual units disposed on cabinet 14, these units can also be provided in a unitary cabinet or any other suitable enclosure as the particular application being made requires. The automated dispensing line and money activated consumer interactive control will now be described in more detail.

Money validator unit B may be any suitable conventional money validator, such as presently used on cold drink cup machines. The validator accepts the correct change if it is available. If correct change is not available, it will accept a dollar bill and return the correct change. When the correct amount of money is received by the money validator unit, it will generate a cycle start signal which will start a dispensing cycle. Cup dispenser C may be any suitable cup dispenser such as is used in cold drink cup machines. The dispenser may dispense cup sizes of 12, 14, or 16 ounces. Ice dispenser D may be any suitable conventional type of ice dispenser unit, such as that manufactured by the Manitowoc Equipment Works Company of Manitowoc, Wisconsin, Model No. MF050. Typically, such an ice dispenser unit is manually filled with ice. However, a conventional ice maker 15 may also be provided in combination with the ice dispenser D for automatically maintaining a supply of ice for the ice dispenser.

Beverage dispenser E may be any suitable dispenser such as a conventional soda fountain dispenser manufactured by Lancer Corporation of San Antonio, Tex., Model No. 1000. A typical soda fountain includes a cabinet 16 which encloses a compressor and refrigeration coil which maintain a cold water bath (not shown). The conventional soda fountain typically includes a plurality of mixing and dispensing nozzles 18 (FIG. 3, nozzles 18*a*–18*e*) corresponding to different syrup flavors and beverages. The conventional nozzle 18 both mixes and dispenses a beverage so that when the beverage reaches the cup is already mixed. No mixing occurs in the cup as does occur with the conventional cold drink cup machine. Furthermore, there is virtually no distance between the cold water bath and the mixing nozzles in which a supply of warm carbonated water or beverage is allowed to stand. A coil for the carbonated water is also disposed in the cold water bath of the soda fountain unit so that cold syrup and carbonated water are delivered to mixing nozzles 18 where they are mixed and dispensed. A manually actuated dispensing lever 20 is included with each nozzle for starting the flow of beverage from the nozzle 18. Supply cabinet contains a container 22 of carbon dioxide which is attached to a carbonator 24. Carbonator 24 may be any suitable carbonator such as a Model No. P300092 carbonator manufactured by McCant's Engineering and Manufacturing Company, Inc. of Los Angeles, California. Domestic water is pumped by a pump 26 to carbonator 24. The water and carbon dioxide are mixed by the carbonator and dispensed to the soda fountain unit E in a conventional manner. The pressurized gas from the carbon dioxide container 22 also drives a plurality of conventional syrup pumps 28. Syrup pumps 28 may be any suitable syrup pumps such as that manufactured by Sure-Flow Beverage Company of Santa Ana, California, Model No. 166-200-05. These pumps are commonly referred to as a "bag in a box pump". This is because the syrup concentrate sources 30 are typically provided by cardboard boxes 30 containing plastic bags 32 filled with syrup. As can best be seen in FIG. 2, supply cabinet F discloses six syrup boxes. Five of the syrup boxes are attached to syrup pumps 28. A sixth syrup box is provided in the cabinet for storage of the most popular syrup. As can best be seen in FIG. 1, there is a drain tray 34 disposed beneath the array of syrup boxes. This is to collect and drain any syrup spilled or leaked from the syrup boxes. Quite advantageously, a rinsing means is provided in the form of a spray nozzle 36 connected by a hose to a hot water source supplied by domestic water. The spray nozzle may be utilized to rinse the connections, typically provided by a screw cap 32*a* and other parts of the syrup boxes which may be found sticky as soiled by syrup. The rinsing of the syrup lines and syrup containers provides a hygienic supply cabinet. The rinsed water is collected in drain tray 34 and collects in a container 38 which may be manually empty. Likewise, a rinsing nozzle 40 is provided at the soda fountain station E to rinse the dispensing unit in a hygienic condition. An instant hot water heater 37 within cabinet 14 is used to supply instantaneous heated water from a domestic source for nozzles 36 and 40. Only hot water will maintain the syrup associated elements in a hygienic condition. A suitable electric water heater for producing instantaneous hot water is manufactured by the Myson Company, Santon Model No. HP 7024s.

Figure 3:
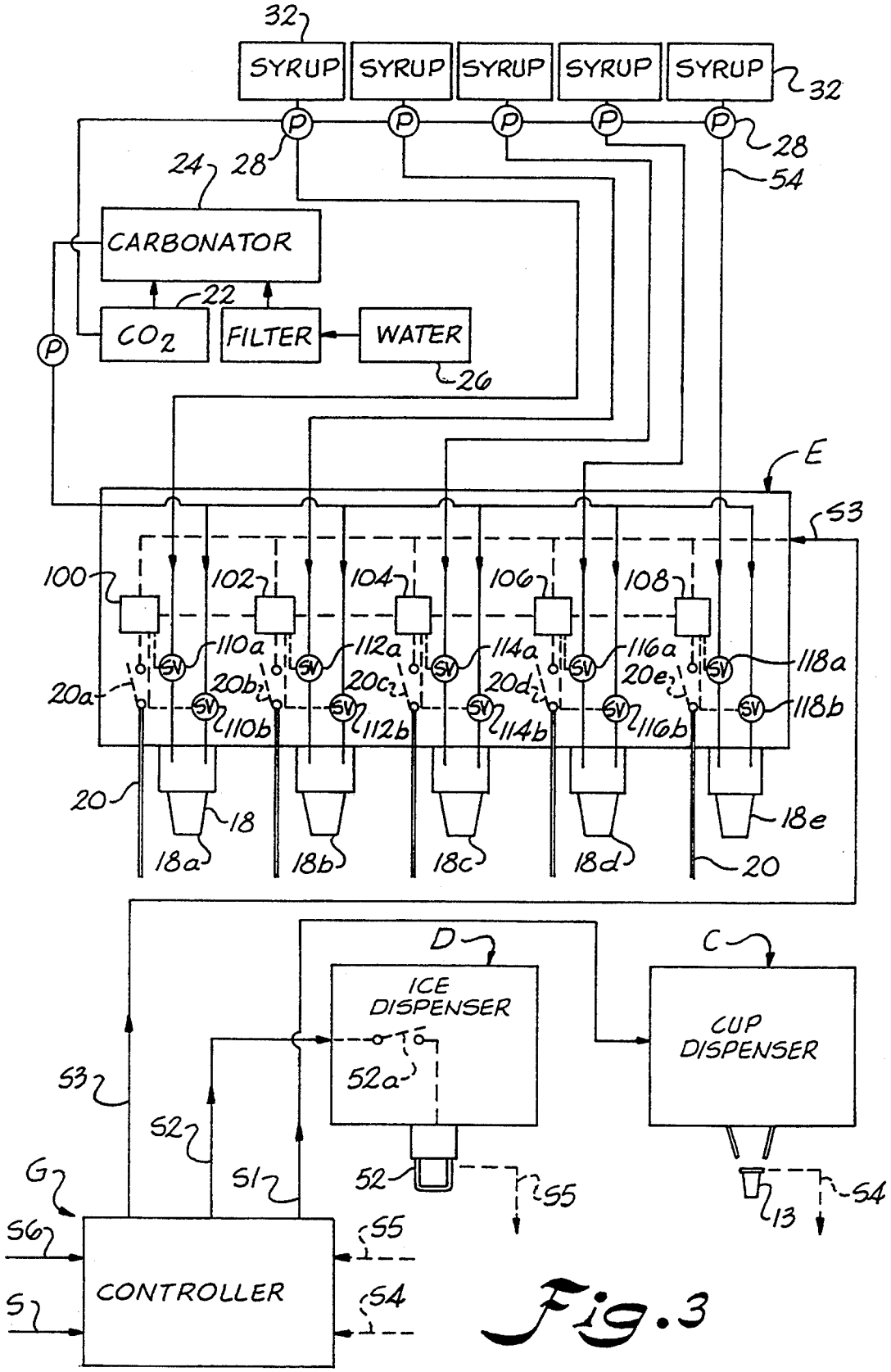
FIG. 3 is a logic diagram of an automatic controller for an automated beverage dispensing line of the soda fountain type according to the invention.

Referring now to FIG. 3, an example of a logic flow diagram for one embodiment of an automatic controller for a consumer interactive beverage dispensing line is illustrated according to the invention. There is a process controller, designated generally as G, illustrated. Control G may be any suitable process controller programmed in a manner well known to those skilled in the automatic control art. For example, as one embodiment of the invention, a start signal S may be generated when the correct amount of money determined by money validator B. Signal S initiates the beginning of the dispensing cycle. In response to signal S, a first signal S1 is generated which activates cup dispenser C to dispense a single cup 10. The controller generates a second signal S2 in response to the dispensing of cup 10 which activates ice dispenser D. The consumer, with cup 10 in hand, then moves to the ice dispensing station where the cup is pressed against a bail lever 52 which actuates a first manual switch 52*a*. This allows ice to be dispensed from the ice dispenser once activated by signal S2. A third signal S3 is generated in response to ice being dispensed which activates the soda fountain unit at beverage dispensing station E. Signal S3 places a voltage across the standard transformer associated with each nozzle, opening the nozzle valves. With the cup in hand, the consumer moves to beverage dispensing station E with the soda fountain unit activated, the consumer presses a desired nozzle lever 20 to select the type of beverage desired. The nozzle lever closes a second manual switch 20*a* which activates the selected pump of the selected syrup box 32 to cause the syrup to be pumped into the soda fountain unit through a line 54. At the same time, carbonated water is pumped through a line 56 from carbonator 24. The syrup concentrate and carbonated water are mixed by nozzle 18 prior to being dispensed.

The signals S1, S2, and S3 may be generated by a timer or may be generated at the end of each dispensing function as detected by a suitable detector. For example, a signal S4 may represent a detector signal from a conventional sensor at cup dispenser C which has detected the dropping of cup 13. Signal S2 may be generated upon receipt of signal S4. Consequently, a signal S5 may be generated by a detector at ice dispenser D telling the controller that the ice has been dispensed. For example, signal S5 may be generated from the release of bail switch 52. Upon receipt of signal S5, the controller may generate a signal S3. After the beverage has been dispensed, as by detecting release of lever 20, a reset signal S6 may be generated to reset the controller and system for a new cycle.

Figure 4:
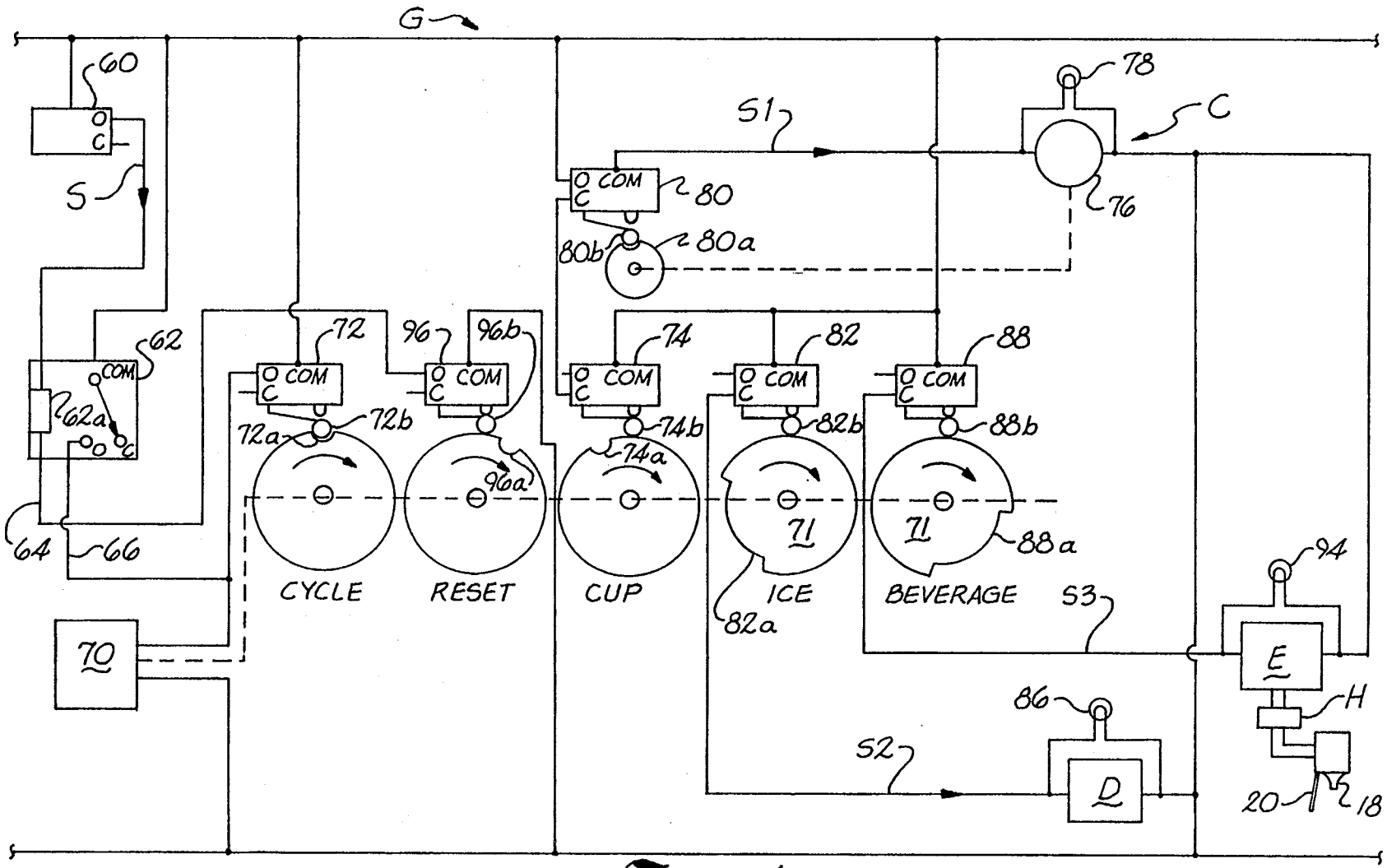
FIG. 4 is a schematic diagram of an example of an automatic controller in the form of an automatic timer control for an automated beverage dispensing line according to the invention.

Referring now to FIG. 4, an example of a controller in the form of a timer is illustrated for controlling the automated beverage line of the soda fountain type disclosed. There is a vend switch 60 which may be located in money validator B. The vend switch is activated by detection of the correct amount of money to generate a cycle start signal S. Vend switch 60 activates a relay 62 as signal S passes through the relay coil 62*a* and establishes a circuit through 64. At that time, the relay contacts close so that power is applied through line 66 to start motor 70. Motor 70 rotates a plurality of timer plates 71 having various detents for timing the dispensing control functions. There are a number of switches actuated by the cams and detents of the timing plates. The switches are in their normal positions when the lobes of the switches are in the detents of the timing plates. A cam operated cycle start switch 72 is actuated and closed after the timer motor 70 turns holding on power to the motor previously powered through relay 62. A cycle reset switch 96, in an actuated condition at the start of a cycle, remains actuated to establish a path through the coil 62*a* of relay 62. A cam switch 74 for cup dispenser C is actuated shortly after start of timing motor 70 as lobe 74*b* falls in detent 74*a*. This supplies power, signal S1, to a cup dispenser motor 76 and also activates a cup light 78 to show that cup dispenser C is ready. The cup motor begins to drive a cam plate having a detent 80*a* which actuates switch 80 and holds the cup motor on for a complete revolution. After one revolution, the cup motor is switched off by switch 80 as lobe 80*b* falls into detent 80*a*. A cam switch 82 controls ice dispenser D through a cam 82*a* and lobe 82*b*. Ice dispenser D is activated when lobe 82*b* falls into the detent 82*a* of the cam generating signal S2. During this time ice light 86 shows the customer that the ice dispenser is activated for operation. The time cycle for ice dispenser D may be adjusted, for example, from 10 to 20 seconds. The ice dispenser is then cut off when lobe 82*b* rises out of the detent 82*a* defining a first prescribed time period. A beverage cam switch 88 having a cam detent 88*a* and lobe 88*b* is subsequently activated when the lobe falls into the detent of the cam to generate signal S3. At this time, beverage dispenser E is activated. Switch 88 places power across a standard 24 volt transformer in each dispensing nozzle 18 of beverage dispenser E as is typical. Power is simultaneously placed across all the dispensing switches 20*a*–20*e* of nozzles 18*a*–18*e* (FIG. 3). With the actuation of a lever 20, switch 20*a*, for example, is actuated which allows carbonated water and fountain syrup to flow through that particular valve. The time that power is applied to the transformer which may be adjustable, and preferably lies in the range of 10–20 seconds, defining a second prescribed time period. A light 94 will be energized when beverage dispenser E is on. There is a cycle reset signal provided by switch 96 having a cam detent 96*a* and lobe 96*b* which terminates power to the relay 62 as the lobe falls into the detent near the end of one complete revolution of timer motor 70. Lobe 96*b* will be moved to the reset position shown in FIG. 4 since the timing motor continues to turn the timing plates simultaneously until lobe 72*b* of the motor switch enters detent 72*a* and power to the motor is finally terminated. Lobe 96*b* falls into detent 96*a* breaking power to relay 62 and the controller to generate cycle reset signal S6. The customer must complete the dispensing of the beverage during the timer cycle. In the diagram of FIG. 4, the cam activated switches 72, and 96 are wired normally open, and 74, 82, and 88 are normally closed.

In summary, after the correct amount of money is detected by validator B, the controller delivers power to the cup dispenser and interrupts power to the money validator. Upon dispensing of a cup, power is delivered to the ice dispenser, and power to the cup dispenser is interrupted. After dispensing of the ice, power is interrupted to the ice dispenser, and power is delivered to the beverage dispenser. When dispensing of the beverage is complete, all of the power is turned off until money is again deposited in the money validator at which time the beverage cycle begins again. Controller G can be programmed in a number of ways to achieve the above results.

Instead of being actuated automatically as described above, it may also be desirable to initiate the dispensing time periods in response to a direct input from the consumer. This would eliminate any possibility that the above ice and beverage time cycles expire before the consumer completes the drink, and facilitate use by those whose completion in a rigidly set time period may be impaired.

Figure 5:
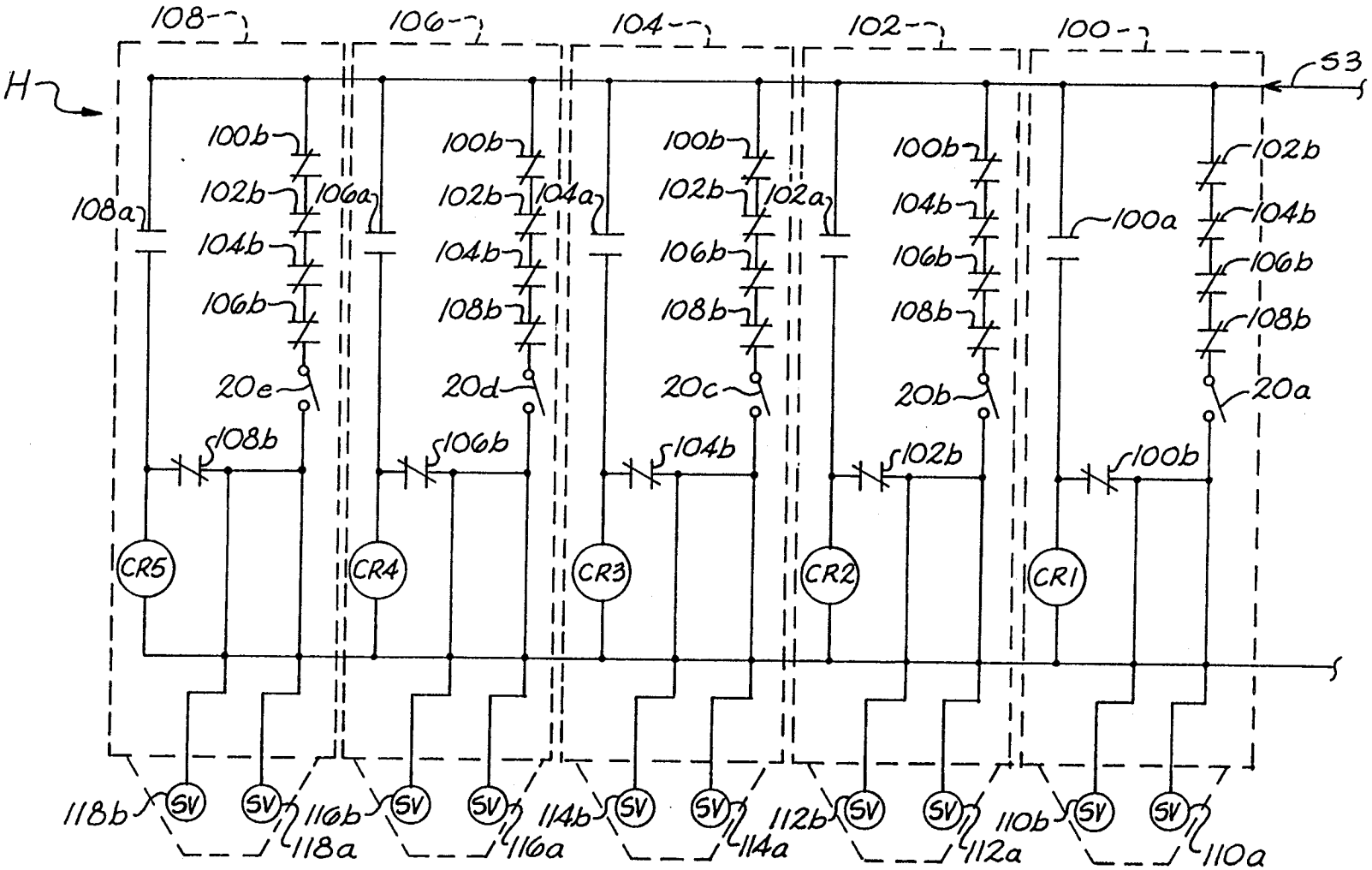
FIG. 5 is a schematic diagram of an interlock control responsive to the selection of a dispensing nozzle to prevent dispensing of beverage from the other nozzles of a beverage dispenser in accordance with a beverage dispensing system and control according to the invention.

It is also desirable to disenable the other dispensing nozzles 18 upon actuation of one lever 20 so that multiple, simultaneous dispensing of beverage is prevented from beverage dispenser E. For example, FIGS. 3 and 5 illustrate an interlock control H which provides one means for locking the remaining nozzles 18 out of operation when a syrup flavor is selected by actuation of a nozzle lever 20 during a dispensing cycle. As can best be seen in FIG. 3, the illustrated embodiment of an interlock control H includes interlock circuits 100, 102, 104, 106, and 108 for syrup nozzles 18*a*, 18*b*, 18*c*, 18*d*, 18*e*, respectively. Circuit 100 controls syrup solenoid valve 110*a* and carbonated water solenoid valve 110*b*. Circuit 102 controls syrup solenoid valve 112*a* and carbonated water solenoid valve 112*b*. Circuit 104 controls syrup solenoid valve 114*a* and carbonated water solenoid valve 114*b*. Circuit 106 controls syrup solenoid valve 116*a* and carbonated water solenoid valve 116*b*. Circuit 108 controls syrup solenoid valve 118*a* and carbonated water solenoid valve 118*b*. Dispensing signal S3 is placed across all of the interlock circuits simultaneously to activate the nozzles and dispense syrup upon actuation of one of the lever switches 20*a*, 20*b*, 20*c*, 20*d*, and 20*e*, respectively. The interlock circuit interrupts signal S3 to the remaining nozzles once one lever 20 has been actuated. For example, if the syrup flavor at nozzle 18*a* is selected by actuation of lever 20, lever switch 20*a* will close. This will activate interlock circuit 100 which actuates solenoid valves 110*a* and 110*b* to allow syrup and carbonated water to flow to nozzle 18*a* respectively. At the same time, interlock circuits 102, 104, 106 and 108 will be deactivated so that the solenoid valves in the syrup and water lines of those circuits are locked out even if another lever switch 20*b*–20*e* is closed. This prevents dispensing of multiple flavors or multiple drinks during a beverage dispensing cycle over the duration of signal S3.

Referring now in more detail to FIG. 5, the details of the interlock circuits can best be seen. Since the operation of each interlock circuit is essentially the same, only one circuit will be described for an understanding of the invention. For example, interlock circuit 100 includes a control relay CR1 having a normally open contact 100*a* and a normally closed contact 100*b*. Control relay contacts 100*a* and 100*b* are overlapping contacts so that contact 100*a* closes before contact 100*b* opens when the control relay is actuated. Interlock circuit 102 includes a second control relay CR2 having a normally open contact 102*a* and a normally closed contact 102*b*. Interlock circuit 104 includes a third control relay CR3 having a normally open contact 104*a* and a normally closed contact 104*b*. Interlock circuit 106 includes a fourth control relay CR4 having an open contact 106*a* and a normally closed contact 106*b*. A fifth interlock circuit 108 includes a fifth control relay CR5 having a normally open contact 108*a* and a normally closed contact 108*b*. When a control relay CR1, CR2, CR3, CR4, CR5 is activated, the two contacts associated with the control relay are reversed from their normal position. All of the control relays include overlapping contacts as described above. The various relay contacts of the control relays are wired as can best be seen in FIG. 5. For example, interlock circuit 100 includes normally closed relay contacts 102*b*, 104*b*, 106*b* and 108*b* in series with lever switch 20*a* of dispensing nozzle 18*a*. On actuation of lever switch 20*a*, signal S3 will be applied across the relay contacts to solenoid valves 110*a* and 110*b* so that syrup and water are delivered to mixing nozzle 18*a*. At the same time, the signal applied across normally closed relay contacts 100*b* is applied through the control relay CR1 which reverses the relay contacts closing relay contact 100*a* and opening relay contact 100*b*, as previously described. Open relay contact 100*b* is in series with the nozzle switch in each remaining interlock circuit 102, 104, 106 and 108. The open relay contact prevents the activation of the remaining interlock circuits in the event that any of the other nozzle switches 20*b*–20*e* is actuated. Also, it will be noted that while interlock circuit 100 is activated, the dispense lever switch 20*a* may be opened and closed any number of times. This will allow the consumer to fill his cup with beverage, allow the cup to defoam, and continue filling the cup until full. This type of intermittent operation is often necessary to fill a cup with beverage without excess foam. Once the time period for the beverage dispensing cycle is over, the signal S3 will no longer be applied to the interlock circuits and no further dispensing of beverage may be had. The contacts of the selected control relay return to their normal positions. The remaining interlock circuits 102–108 operate the same when an associated nozzle switch 20*b*–20*e* is actuated to dispense beverage through associated solenoid valves 112*a*–118*a* and 112*b*–118*b* while locking out the remaining nozzles.

In summary, whichever interlock circuit is first activated by closure of a nozzle switch 20*a*–20*e*, that circuit has a normally closed relay contact in the other circuits which is open as long as the first interlock circuit is activated. In addition, the nozzle switch of the activated circuit may be open and closed as many times as desired during the signal S3 while maintaining the other nozzles deactivated. The above described interlock circuits may be easily adapted to an existing beverage dispenser E having been taught the advantages of the present invention.

Variations and enhancements may become apparent having been taught the principles of the present invention. For example, solid state electronic controls may be employed for the timing controls and interlock control. It may be desired that the dispensing stations are activated simultaneously, instead of sequentially, and that consumer interaction at each station, by a switch and the like, directly initiates the dispensing at each station with a total time lapse signal ending the cycle. Coin validator B may include a push button which selects the flavor from the fountain. For example, the validator may contain five buttons, a button for each item, tea, cola, etc. The cup dispenser may contain different size cups and dispense the correct size cup depending upon the amount of money deposited in the validator. The control may also be programmed to dispense the right quantity of ice for the cup selected. The amount of syrup dispensed at dispenser E, depending upon the cup size, may also be programmed.

Thus, it can be seen that a highly advantageous money operated beverage dispensing line can be had in accordance with the invention which resembles the conventional soda fountain dispensing lines found in convenience stores, fast food restaurants, and the like which automatically controls the dispensing of cup, ice, and beverage with consumer interaction so that the feel of a self-made drink of consistently high quality is had without waste and thievery.

While a preferred embodiment of the invention has been described using specific terms, such description is for illustrative purposes only, and it is to be understood that changes and variations may be made without departing from the spirit or scope of the following claims.

What is claimed is:

1. A money operated beverage dispensing system for dispensing a beverage to a consumer in an automated and interactive manner comprising:

a beverage dispensing line having a series of remote dispensing stations controlled automatically and operated with consumer interactive, said beverage line including;

a money validator for receiving money from a consumer, and the money validator generating a start signal representing a start of a beverage dispensing cycle in response to detecting a prescribed amount of money, a cup dispensing station having a cup dispenser for dispensing a cup which is manually received and transported to subsequent stations by said consumer, a remote ice dispensing station spaced a distance from said cup dispensing station to which said cup is transported by said consumer having an ice dispenser for dispensing ice into said cup manually positioned by said consumer at said ice dispenser, a first switch associated with said ice dispenser and actuated by said consumer for dispensing said ice into said cup during ice actuation times when said ice dispenser is activated, a remote beverage dispensing station spaced a distance from said ice dispensing station to which said cup is transported by said consumer having a beverage dispenser for dispensing a beverage into said cup manually positioned by said consumer, a second switch associated with said beverage dispenser and manually actuated by said consumer for dispensing said beverage into said cup during beverage actuation times when said beverage dispenser is activated; and an automatic controller for controlling said cup dispenser, said ice dispenser, and said beverage dispenser;

said controller activating said cup dispenser to dispense said cup in response to said start signal, said controller including an ice dispensing timer having a first prescribed time period for activating said ice dispenser during said first prescribed time period for dispensing an amount of ice into said manually positioned cup dependent only upon said ice actuation times in which said first switch is manually actuated by said consumer during said first prescribed time period; and said controller including a beverage dispensing timer having a second prescribed time period for activating said beverage dispenser during said second prescribed time period for dispensing an amount of beverage into said manually positioned cup dependent only upon said beverage actuation times in which said second switch is manually actuated by said consumer during said second prescribed time period.

2. The system of claim 1 wherein said automatic controller includes:

a cup dispensing timer for generating a first signal to activate said cup dispenser;

said ice dispensing timer generating a second signal for activating said ice dispenser during said first prescribed time period;

said beverage dispensing timer generating a third signal for activating said beverage dispenser during said second prescribed time period.

3. The system of claim 2 wherein said beverage dispenser includes a plurality of beverage dispensing nozzles for dispensing a plurality of beverages, said dispensing nozzles having associated nozzle switches constituting said second switches for activating a selected beverage dispensing nozzle; and an interlock control which includes a plurality of interlock circuits associated with said dispensing nozzle switches, said interlock circuits being responsive to actuation of a selected nozzle switch associated with a selected beverage dispensing nozzle for disenabling a remainder of said dispensing nozzles so that dispensing of beverage from said remainder of dispensing nozzles is prevented during said second prescribed time period.

4. The system of claim 3 wherein said third signal is supplied to said interlock control circuits and to said nozzles switches simultaneously, and said interlock control circuits interrupt delivery of said third signal to said remainder of nozzle switches in response to actuation of said selected nozzle switch.

5. The system of claim 2 wherein said controller generates a reset signal for resetting said beverage dispensing cycle after said second prescribed time period.

6. The system of claim 1 wherein said beverage dispenser includes a plurality of beverage dispensing nozzles for dispensing a plurality of beverages, a plurality of associated nozzle switches constituting said second switches for activating said beverage dispensing nozzles when actuated; and an interlock control which includes a plurality of interlock circuits associated with said dispensing nozzle switches, said interlock circuits being responsive to actuation of a selected nozzle switch associated with a selected beverage dispensing nozzle for disenabling a remainder of said dispensing nozzles so that dispensing of beverage from said remainder of dispensing nozzles is prevented during said beverage dispensing cycle.

7. The system of claim 1 including a visual indicator associated at least with said ice dispenser and said beverage dispenser indicating that said ice dispenser and said beverage dispenser are activated and ready for manual operation by the consumer.

8. The system of claim 1 including a separate supply cabinet disposed a distance remote from said dispensing line, said supply cabinet enclosing a plurality of beverage syrup sources and beverage pumps for transferring beverage syrup from said beverage source to said beverage dispenser, a carbonator for supplying carbonated water to said beverage dispenser; and beverage syrup and carbonated water transfer lines connected between said remote supply cabinet and said dispensing line for transferring said beverage syrup and said carbonated water from said supply cabinet to said dispensing line.

9. The system of claim 8 including a spill tray carried underneath said beverage sources having a drain, and means for rinsing said spill tray to clean said tray from spills of said beverage syrup.

10. The system of claim 1 wherein said beverage dispensing unit comprises a plurality of mixing and dispensing nozzles which mix carbonated water with said beverage syrup for dispensing said beverage.

11. The system of claim 10 wherein said dispensing station includes rinsing means for rinsing said mixing and dispensing nozzles to maintain said nozzles in a hygienic condition.

12. The system of claim 11 including a drain, and said beverage dispensing station includes a collection tray for collecting and draining said rinsing fluid.

13. The system of claim 3 wherein said interlock circuits include said second, beverage nozzle switches said interlock circuits further include first and second interlock switches; and said first interlock switch being closed in response to said third signal and said actuation of said selected nozzle switch for activating said selected beverage dispensing nozzle, and said second interlock switch being opened in response to said third signal and said actuation of said selected nozzle switch for deactivating said remainder of said beverage dispensing nozzles while permitting repeated actuation of said selected nozzle switch and dispensing of said selected beverage during said second prescribed time period to top off said beverage in said cup.

14. The system of claim 1 wherein said cup dispenser is disposed in a cup dispensing housing; said ice dispenser is disposed in an ice dispenser cabinet separate from said cup dispenser housing; said beverage dispenser is contained with a beverage dispenser cabinet separate from said cup dispenser housing and said ice dispenser cabinet; and said cup dispenser housing, ice dispenser cabinet, and said beverage dispenser cabinet being disposed at remote locations relative to each other along said beverage dispensing line.

15. The system of claim 14 including a separate supply cabinet disposed a distance remote from said dispensing line, said supply cabinet enclosing a plurality of beverage syrup sources and beverage pumps for transferring beverage syrup from said beverage source to said beverage dispenser, a carbonator for supplying carbonated water to said beverage dispenser; and beverage syrup and carbonated water transfer lines connected between said remote supply cabinet and said dispensing line for transferring said beverage syrup and said carbonated water from said supply cabinet to said dispensing line.

16. The system of claim 1 wherein said controller activates said cup dispenser, said ice dispenser, and said beverage dispenser sequentially in a manner that only one of said dispensers is activated at a time.

17. A money operated beverage dispensing system for dispensing a beverage to a consumer in an automated and interactive manner comprising:

a money validator for receiving money from a consumer, and said money validator generating a first signal representing a start of a beverage dispensing cycle in response to detecting a prescribed amount of money;

a cup dispensing station having a cup dispenser for dispensing a cup;

an ice dispensing station having an ice dispenser for dispensing ice into said cup positioned at said ice dispenser;

a first switch associated with said ice dispenser and actuated by said consumer for dispensing said ice into said cup during ice actuation times of said first switch;

a beverage dispensing station having a beverage dispenser with a plurality of beverage dispensing nozzles for dispensing a selected beverage into said cup positioned at said beverage dispensing station;

a plurality of second, beverage nozzle switches associated with said beverage dispensing nozzles and manually actuated by said consumer for dispensing said selected beverage into said cup during beverage actuation times of a selected nozzle switch;

an automatic controller for controlling said cup dispenser, said ice dispenser, and said beverage dispenser; p1 said controller activating said cup dispenser to dispense said cup in response to said first signal and afterwards generating a second signal and a third signal for activating said ice and beverage dispensers, respectively;

said controller having a first prescribed time period for activating said ice dispenser dispensing an amount of ice into said cup dependent only upon said ice actuation times of said first switch by said consumer while said ice dispenser is activated;

said controller having a second prescribed time period for activating said beverage dispenser in response to said third signal, and said activated beverage dispenser dispenses an amount of beverage into said cup dependent only upon said beverage actuation times of said second switch by said consumer while said beverage dispenser is activated.

18. The system of claim 17 including an interlock control which includes a plurality of interlock circuits associated with said dispensing nozzle switches, said interlock circuits being responsive to actuation of said selected nozzle switch associated with a selected beverage dispensing nozzle for disenabling a remainder of said nozzle switches so that dispensing of beverage from said remainder of beverage nozzles is prevented.

19. The system of claim 18 wherein said third signal is supplied to said interlock control circuits and to said beverage nozzle switches simultaneously, and said interlock control circuits interrupt delivery of said third signal to said remainder of nozzle switches in response to actuation of said selected nozzle switch during said second prescribed time period.

20. The system of claim 17 including a visual indicator associated with at least said ice dispenser and said beverage dispenser indicating that said ice dispenser and said beverage dispenser are activated by said controller.

21. The system of claim 17 including a separate supply cabinet disposed a distance remote form said dispensing line, said supply cabinet enclosing a plurality of beverage syrup sources and beverage pumps for transferring beverage syrup from said beverage source to said beverage dispenser, a carbonator for supplying carbonated water to said beverage dispenser; and beverage syrup and carbonated water transfer lines connected between said remote supply cabinet and said dispensing line for transferring said beverage syrup and said carbonated water from said supply cabinet to said dispensing line.

22. The system of claim 21 including a spill tray carried underneath said beverage sources having a drain, and means for rinsing said spill tray to clean said tray from spills of said beverage syrup.

23. The system of claim 17 wherein said beverage dispensing unit comprises a plurality of mixing and dispensing nozzles which mix carbonated water with said beverage syrup for dispensing said beverage.

24. The system of claim 23 wherein said dispensing station includes rinsing means for rinsing said mixing and dispensing nozzles to maintain said nozzles in a hygienic condition.

25. The system of claim 24 including a drain, and said beverage dispensing station includes a collection tray for collecting and draining said rinsing fluid.

26. The system of claim 17 wherein said automatic controller comprises an ice timer for activating said ice dispenser for said first prescribed time period in response to said second signal; and a beverage timer for activating said beverage dispenser for said second prescribed time period in response to said third signal.

27. The system of claim 17 wherein said controller activates said cup dispenser, said ice dispenser, and said beverage dispenser sequentially in a manner that only one of said dispensers is activated at a time.

28. A method for automatically controlling a beverage dispensing line with consumer interaction, said dispensing line having a series of remote dispensing stations including a cup dispensing station having a cup dispenser for dispensing a cup which is manually received and transported to subsequent stations by a consumer, a remote ice dispensing station spaced a distance from said cup dispensing station to which said cup is transported by said consumer having an ice dispenser for dispensing ice into said cup manually positioned by said consumer at said ice dispenser, a first switch associated with said ice dispenser which is manually actuated by said consumer for dispensing said ice into said cup during ice actuation times of said first switch, a remote beverage dispensing station spaced a distance for said ice dispensing station to which said cup is transported by said consumer having a beverage dispenser for dispensing a beverage manually positioned by said consumer, said beverage dispenser comprising a plurality of dispensing nozzles and a plurality of second, nozzle switches associated with said beverage dispensing nozzles which are manually actuated by said consumer for dispensing a selected beverage into said cup during beverage actuation times of said second switches; said method comprising:

providing a money validator which receives money;

generating a start signal in response to said money validator detecting a prescribed amount of money representing a start of a beverage dispensing cycle;

automatically controlling said cup dispenser to dispense a cup in response to said start signal;

activating said ice dispenser during a first fixed preset time period, automatically dispensing said ice from said activated ice dispenser into said cup upon manual actuation of said first switch by said consumer dependent only upon said ice actuation times of said first switch during said first fixed preset time period;

activating said beverage dispenser during a second fixed preset time period, and automatically dispensing said prescribed amount of beverage into said manually positioned cup upon actuation of said second switch by said consumer dependent only upon said beverage actuation times of said second switch during said second fixed preset time period.

29. The method of claim 28 including activating visual indicators associated at least with said ice dispenser and said beverage dispenser indicating that said ice dispenser and said beverage dispenser are activated in response to said first and second signals, respectively.

30. The method of claim 28 including delivering said beverage which is being dispensed by said beverage dispenser through a delivery line form a separate supply cabinet disposed a distance remote from said beverage dispensing line.

31. The method of claim 28 including dispensing said beverage from a mixing and dispensing nozzle which mixes carbonated water with said concentrate for forming said beverage.

32. The method of claim 28 comprising:

resetting said beverage dispensing cycle at the end of said second fixed time period of said beverage dispenser activation.

33. The method of claim 28 comprising:

automatically activating said beverage dispenser to dispense an amount of beverage into said cup positioned at said beverage dispenser upon manual actuation of one of said nozzle switches by said consumer; and automatically interrupting power to the other of said nozzle switches upon actuation of said one nozzle switch during said second fixed time period.

34. The method of claim 33 including enabling repeated actuation of said selected nozzle switch while power is interrupted to said other nozzle switches, and maintaining the interruption of said power to said other nozzle switches during said repeated actuation of said selected nozzle switch to top off said beverage in said cup.

35. The method of claim 34 including interrupting power to said other nozzles continuously during said second fixed time period to prevent sequential and simultaneous operation of said other beverage nozzles during said second fixed time period.

* * * * *